United States Patent [19]

Ko

[11] 4,205,529

[45] Jun. 3, 1980

[54] LICL DEHUMIDIFIER/LIBR ABSORPTION CHILLER HYBRID AIR CONDITIONING SYSTEM WITH ENERGY RECOVERY

[75] Inventor: Suk M. Ko, Huntsville, Ala.

[73] Assignee: The United States of America as represented by the United States Department of Energy, Washington, D.C.

[21] Appl. No.: 966,524

[22] Filed: Dec. 4, 1978

[51] Int. Cl.[2] ..... F25B 27/00; F25B 27/02; F25D 23/00; F25B 13/00

[52] U.S. Cl. ..... 62/2; 62/238; 62/271; 62/324

[58] Field of Search ..... 62/2, 238 B, 324 B, 62/271

[56] References Cited

U.S. PATENT DOCUMENTS

| | | | |
|---|---|---|---|
| 3,417,574 | 12/1968 | Kelley | 62/271 X |
| 4,011,731 | 3/1977 | Meckler | 62/2 |
| 4,070,870 | 1/1978 | Bahel et al. | 62/238 B |
| 4,164,125 | 8/1979 | Griffiths | 62/2 |

*Primary Examiner*—Lloyd L. King
*Attorney, Agent, or Firm*—R. V. Lupo; Stephen D. Hamel; Louis M. Deckelmann

[57] ABSTRACT

This invention relates to a hybrid air conditioning system that combines a solar powered LiCl dehumidifier with a LiBr absorption chiller. The desiccant dehumidifier removes the latent load by absorbing moisture from the air, and the sensible load is removed by the absorption chiller. The desiccant dehumidifier is coupled to a regenerator and the desiccant in the regenerator is heated by solar heated hot water to drive the moisture therefrom before being fed back to the dehumidifier. The heat of vaporization expended in the desiccant regenerator is recovered and used to partially preheat the driving fluid of the absorption chiller, thus substantially improving the overall COP of the hybrid system.

6 Claims, 4 Drawing Figures

LICL DEHUMIDIFIER/LIBR ABSORPTION CHILLER HYBRID AIR CONDITIONING SYSTEM WITH ENERGY RECOVERY

BACKGROUND OF THE INVENTION

This invention was made in the course of, or under, a contract with the U.S. Department of Energy.

A conventional air conditioning system for residential, commercial and industrial space cooling is a heated hot water driven lithium bromide absorption chiller. However, the coefficient of performance (COP) of such a system is about 0.7. It would be desirable and there exists a need to provide an improved system wherein the COP can be increased while at the same time recovering and utilizing otherwise lost energy. The present invention was conceived to meet this need in a manner to be described hereinbelow.

SUMMARY OF THE INVENTION

It is the object of the present invention to provide an improved air conditioning system in which the COP can be increased by recovering and utilizing energy that would otherwise be lost.

The above object has been accomplished in the present invention by providing a hybrid air conditioning system that combines a solar powered LiCl dehumidifier with a LiBr absorption chiller. The driving fluid of the absorption chiller can be supplied by a conventional hot water heater, a solar heater, a steam boiler, or a low temperature waste heat source. The desiccant dehumidifier removes the latent load by absorbing moisture from the air, and the sensible load is removed by the absorption chiller. The desiccant dehumidifier is coupled to a regenerator and the desiccant in the regenerator is heated by solar heated hot water to drive the moisture therefrom before being fed back to the dehumidifier. The heat of vaporization expended in the desiccant regenerator is recovered and used to partially preheat the driving fluid of the absorption chiller, thus substantially improving the COP of the hybrid system.

DESCRIPTION OF THE PREFERRED EMBODIMENTS

Figure 1:
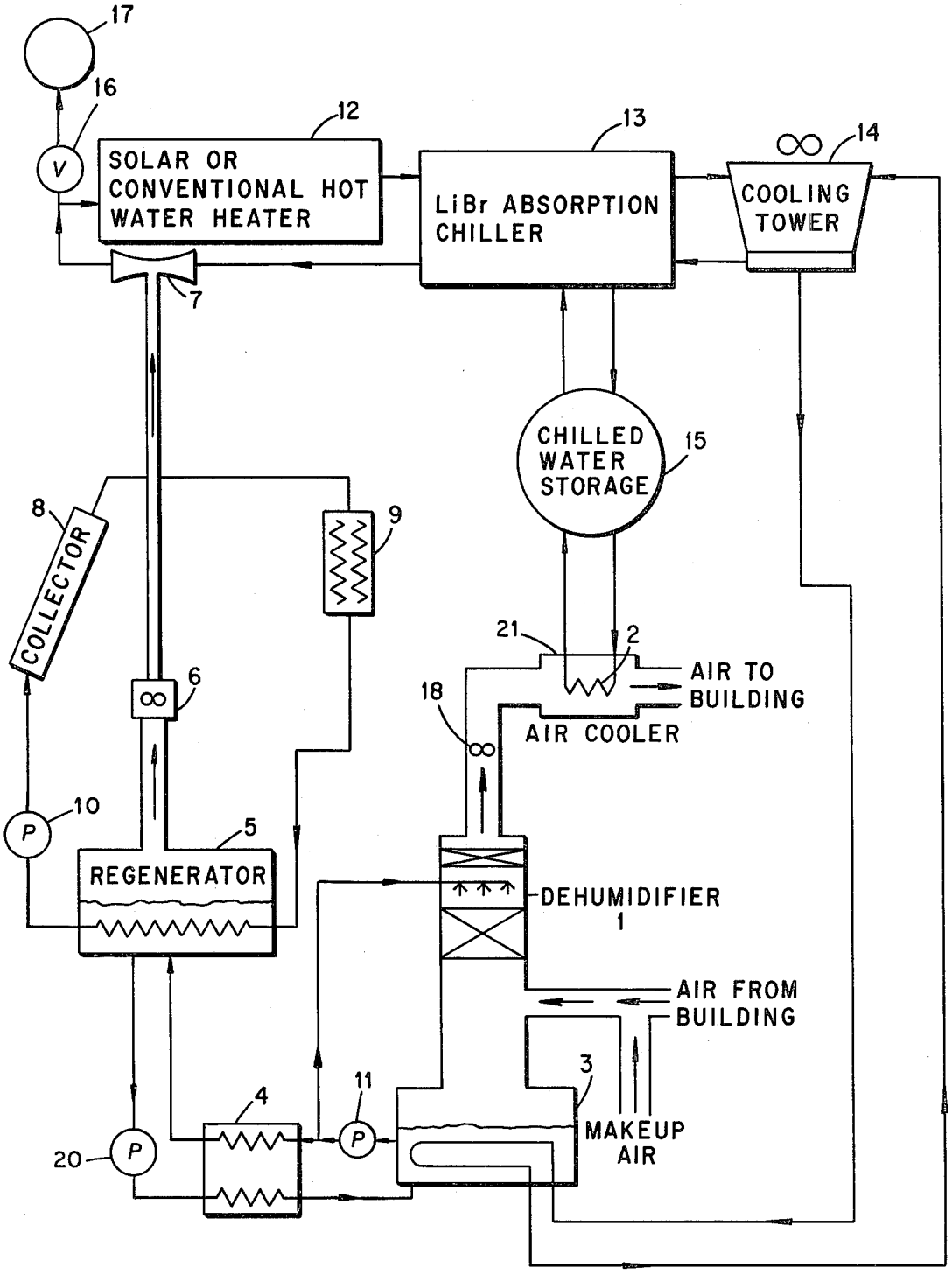
FIG. 1 is a schematic illustration of the hybrid air conditioning system of the present invention.

With reference to FIG. 1 of the drawings, a dehumidifier 1 is provided which is a packed absorption column, for example. Hot, regenerated desiccant such as an aqueous solution of lithium chloride, for example, is fed from a regenerator 5 through a heat exchanger 4 by means of a pump 20 to the absorption column of the dehumidifier 1 by way of a sump 3 and a pump 11. Air from the building to be cooled is combined with make-up air and drawn through the absorption column by means of a blower fan 18. The desiccant thus removes the moisture (latent load) from the air that is fed to the dehumidifier.

Figure 3:
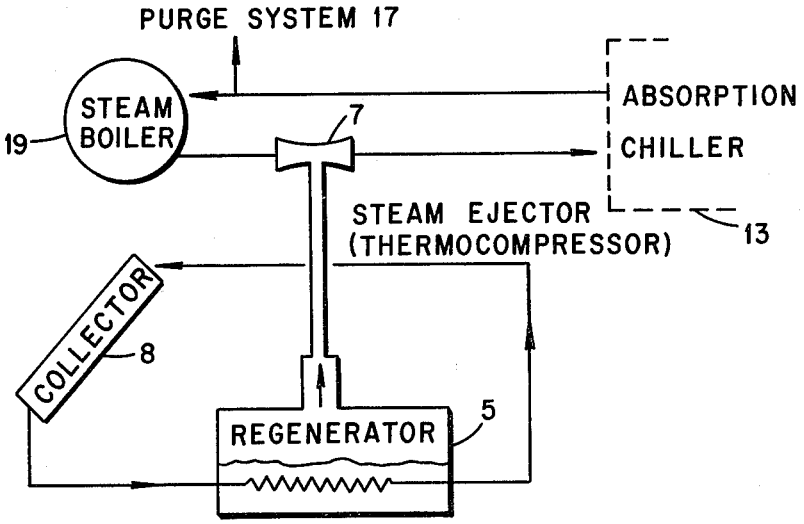
FIG. 3 is a schematic illustration of another modification of the system of FIG. 1 utilizing a steam-driven absorption chiller.
Figure 4:
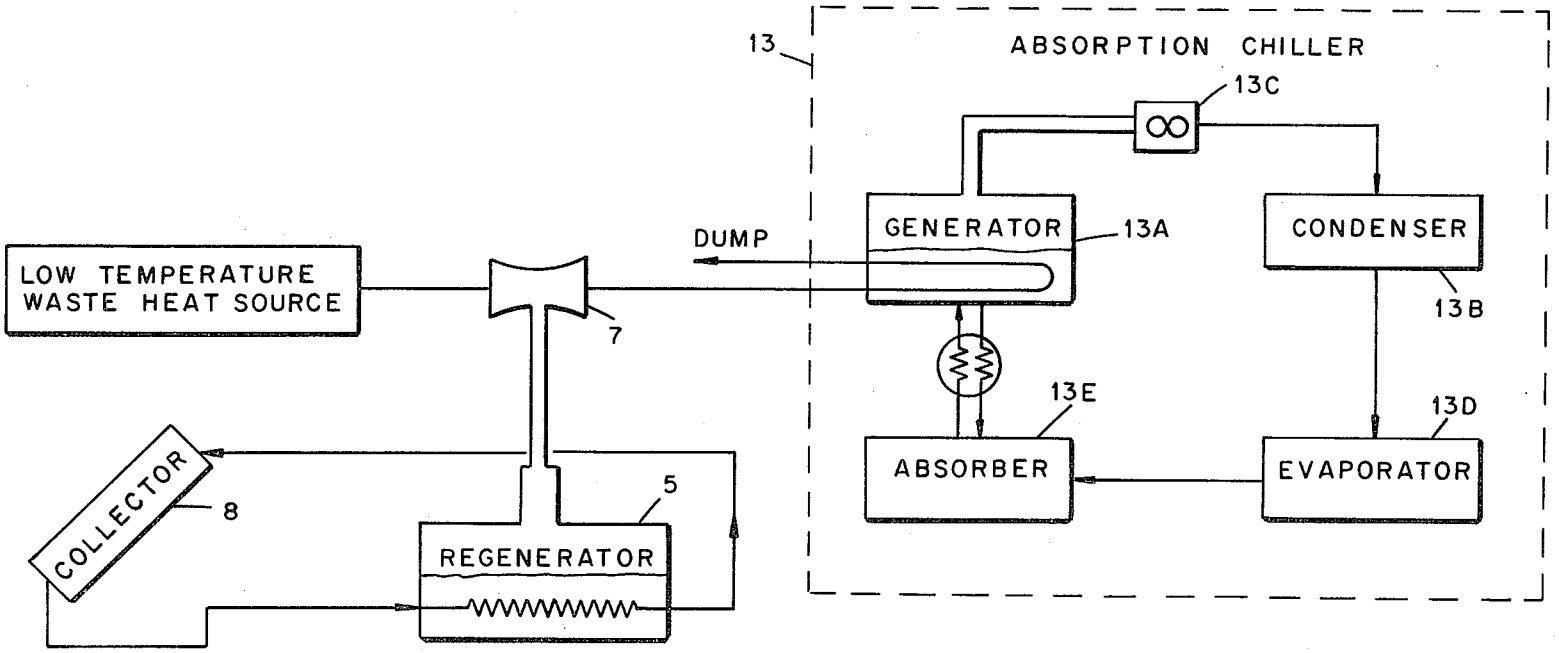
FIG. 4 is a schematic illustration of still another modification of the system of FIG. 1 utilizing a low temperature solar hot water or waste heat driven absorption chiller.

An absorption chiller 13 which is a LiBr chiller, for example, is provided with a vapor generator, a condenser, an evaporator and an absorber, as illustrated in FIG. 4. These individual units are not shown in FIGS. 1, 2 and 3 for the sake of clarity.

The sump 3 in FIG. 1 is utilized for collecting the used desiccant and for receiving the regenerated hot desiccant from the regenerator 5. The desiccant in the sump 3 is cooled by a cooling water line mounted therein which cooling line is coupled to a cooling tower 14. The cooling water line in the sump 3 is utilized to remove the thermal energy absorbed by the desiccant in the dehumidification process. The tower 14 in turn is coupled to the condenser of the absorption chiller 13. The evaporator of the absorption chiller 13 also supplies chilled water to a storage unit 15 which in turn is coupled to a cooling unit 2 in an air cooler 21 where the sensible load is removed from the dehumidified air flowing therethrough before exiting back to the building being cooled.

The desiccant from the sump 3 is pumped either to the top of the dehumidifier 1 or fed to the regenerator 5 through the heat exchanger 4 by means of a pump 11. Thus, the dilute desiccant from the sump 3 is pretreated in the liquid/liquid heat exchanger 4, using regenerated hot desiccant as the heat source. It should be understood that suitable valves are provided in FIG. 1, not shown, for selectively feeding the desiccant from the sump 3 to the top of the dehumidifier 1 or to the regenerator 5 for regeneration. The heating medium for the regenerator 5 is provided by solar heated hot water which water is heated in a solar collector 8 to a temperature of 200° F., for example, and by means of an auxiliary electrical heater 9, if desired or required, before being fed back to the regenerator 5. Circulation of the water through the units 5, 8, and 9 is effected by means of a pump 10. The hot water flowing through the heating coil in the regenerator 5 provides a regeneration temperature of 200° F., for example. Thus, the water vapor absorbed in the dilute desiccant fed to the regenerator 5 from the sump 3 is driven off in the regenerator by the heating medium therein, and the now hot, regenerated desiccant is fed back by means of a pump 20 through the heat exchanger 4 to the sump 3 from which it is then pumped to the top of the dehumidifier 1, as mentioned above.

In order to provide the required water evaporation rate from the regenerator 5, an evacuating means is required. The evacuation is accomplished through an ejector system including an ejector 7 coupled between the units 5 and 12 and which requires a driving fluid. The unit 12 is a solar or conventional hot water heater. The driving fluid is the heat transfer fluid for the vapor generator of the lithium bromide absorption chiller 13 and this driving fluid is partially heated in the unit 12 and partially heated by the energy recovered from the regenerator 5 as discussed below. Thus, this arrangement serves as an energy recovery device, i.e., the heat of vaporization expended in the desiccant regenerator is recovered and used to partially preheat the driving fluid of the absorption chiller 13 and the heater unit 12 supplies the remaining heat required for heating the driving fluid of the chiller 13. In order to be able to operate the regenerator 5 at the desired 200° F. temperature, a low pressure compressor 6 is provided and utilized in the vapor output line from the regenerator such as to compress the water vapor from the regenerator 5 to a higher pressure than that of the saturation vapor pressure of the above-mentioned driving fluid (7.5 psia at 180° F.). At the desiccant regeneration temperature of 200° F., the required compression ratio is approximately 2.5, and at this ratio the horse power required for a 1-ton latent load system is less than 1 hp, which is equivalent to about 100 Btu/lb water vapor compressed. In other words, the net energy recovery is roughly 90%. This energy recovery will reduce the otherwise necessary input to the absorption chiller from the hot water source 12, and consequently will give a significantly higher COP for the overall air conditioning system. It should be noted that without the use of the compressor unit 6, the solar collector 8 would have to supply heating water to the regenerator 5 at a temperature of at least 250° F., which is not desirable for a flat plate collector.

It should be noted, however, that the compressor unit 6 may be eliminated for applications where the use of 250° F. hot water is economical.

A purge system 17 is also coupled to the ejector 7 through a valve 16 for purging the non-condensables and any excess water from the output of the regenerator 5.

Typical operating parameters for the above-described hybrid air conditioning system designed for the sensible load of 25 tons and the latent load of 8.3 tons are set forth in the following Table:

TABLE

Dehumidifier
- Operating Desiccant Concentration Range: 36 to 43% LiCl
- $H_2O$ Removal Rate: 100 lb/hr for 16 hrs
- Quantity of Desiccant Required for 8-hr Storage: 8,000 lb
- LiCl Solution
- Cooling Water Flow Rate: 24,000 lb/hr (50 gpm)

Regenerator
- $H_2O$ Removal Rate: 200 lb/hr for 8 hrs
- Operating Temperature: 200° F.
- Desiccant Flow Rate: 1,000 lb/hr
- Operating Pressure: 2 psia Collector
- Energy Input: 260,000 Btu/hr
- Water Flow Rate: 26,000 lb/hr
- Temperature: 200° F.

Energy Recovery System
- Thermal Energy Recovered: 200,000 Btu/hr
- Compressor Energy Required: 20,000 Btu/hr (5.9 kW)
- Net Energy Recovered: 180,000 Btu/hr It should be noted that the overall COP of the above-described system is a function of the latent load. For example, at a latent load of 25% and based on a conventional absorption chiller COP of 0.7, the overall COP of the present system would be about 0.85 which is equivalent to an energy saving of 3,000 Btu/hr/ton of refrigeration over conventional absorption chiller systems. For a latent load of 50%, the overall COP of the present system would be as high as 1.1, which is equivalent to an energy saving of 6,000 Btu/hr/ton of refrigeration over conventional absorption chiller systems.

Figure 2:
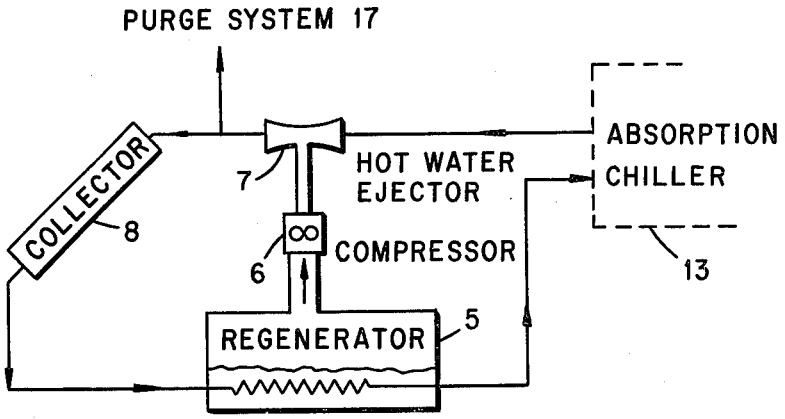
FIG. 2 is a schematic illustration of a modification of the system of FIG. 1 utilizing a solar hot water driven absorption chiller.

A modification of the system of FIG. 1 is illustrated in FIG. 2 of the drawings, wherein the unit 12 of FIG. 1 is not utilized and a common solar collector 8 in FIG. 2 is utilized for heating the driving fluid for the vapor generator of the chiller 13 and for supplying the heating medium for the regenerator 5. The common solar collector 8 in FIG. 2 will provide an increase in the collection efficiency thereof due to the increased $\Delta T$ across the collector. It should be understood that the rest of the system in FIG. 2 is not shown but is the same as shown in FIG. 1 and functions in the same manner.

A further modification of the system of FIG. 1 is illustrated in FIG. 3 of the drawings, wherein only the modified parts are shown. In FIG. 3, a steam boiler 19 is provided and it is coupled through the ejector 7 for driving the vapor generator of the absorption chiller 13. In this arrangement, the energy recovered from the regenerator 5 reduces the amount of energy that would normally be required from the boiler 19 if it were used alone to drive the chiller 13. It should be noted that when steam is used to drive the chiller 13, the mechanical compressor 6 is not necessary since the ejector 7 can provide the required vacuum in the regenerator by controlling the steam pressure. This type of steam ejector is often called a thermocompressor.

A still further modification of the system of FIG. 1 is illustrated in FIG. 4 of the drawings, wherein only the modified parts are shown. In FIG. 4, the driving fluid for the vapor generator 13A of the chiller 13 is provided from an industrial or utility low temperature (110°-150° F.) waste heat source. In this arrangement, the energy recovered from the regenerator 5 raises the temperature of the driving fluid for the vapor generator 13A of the chiller 13. The compressor 6 is not required since the temperature of the waste heat fed to the ejector 7 is low enough to condense the water vapor from the regenerator 5. Instead, a compressor 13C which is similar to the compressor 6 is provided between the vapor generator 13A and the condenser 13B of the chiller 13 to maintain the rate of vapor generation in the generator 13A at the desired operating level. The normally specified minimum operating temperature of the vapor generator is 160° F. and the arrangement of FIG. 4 enables operation of the vapor generator 13A at considerably lower temperature than the minimum state-of-the-art temperature. The compression ratio for the compressor 13C is approximately 1.5 at the vapor generator temperature of 130° F., for example, and the corresponding parasitic power requirement is less than 0.1 kW/ton of refrigeration. The arrangement in FIG. 4 provides energy recovery from the desiccant regenerator 5 as well as utilization of low temperature waste heat from various industries and utilities or, if desired, in combination with a low temperature solar collector. It should be noted that the driving fluid for the vapor generator 13A after passing therethrough is fed to a dump, as shown, or it may be utilized for some other purposes if such is desired.

It should be understood that the components of the absorption chiller 13 as illustrated in FIG. 4 are the same as utilized in the embodiments of FIGS. 1, 2, and 3 except for the compressor 13C which is not used in FIGS. 1, 2 and 3. In addition, it should be noted that for all embodiments of the present invention the condenser 13B is coupled to the cooling tower 14 (FIG. 1), and the evaporator 13D is coupled to the chilled water storage unit 15 (FIG. 1).

This invention has been described by way of illustration rather than by limitation and it should be apparent that it is equally applicable in fields other than those described. For example, the invention described herein is equally applicable to a system where the desiccant dehumidifier is coupled with an adsorption chiller, utilizing such adsorbents as zeolites, silica gel or activated carbon, rather than an absorption chiller.

What is claimed is:

1. A hybrid air conditioning system for space cooling a building comprising a desiccant dehumidifier and an absorption chiller, said dehumidifier provided with a packed absorption column, an input air line from said building and an output air line; a desiccant regenerator for providing hot regenerated desiccant to said dehumidifier absorption column; a liquid/liquid heat exchanger coupled between said regenerator and said dehumidifier; a blower fan mounted in said output air line for drawing air from said building and make-up through said absorption column where the latent load of said air is removed by said hot desiccant by absorbing moisture from said air; a desiccant storage sump for collecting the dilute desiccant from said absorption column and said regenerated desiccant from said regenerator; means for pumping said desiccant from said sump either to the top of said dehumidifier or through said heat exchanger back to said regenerator; a solar collector, said regenerator provided with a hot water heating coil coupled to said solar collector; means for continuously pumping the water in said heating coil through said collector and then back to said coil, said collector maintaining said water at a desired heating temperature in said regenerator for driving off the moisture from said dilute desiccant therein; said absorption chiller provided with a vapor generator, a condenser, an evaporator, and an absorber, said condenser coupled to a cooling tower; said desiccant sump provided with a cooling line therein which line in turn is coupled to said cooling tower; a hot water heater for supplying a driving fluid to said vapor generator; said desiccant regenerator provided with an output water vapor line; a low pressure compressor and a hot water driven ejector mounted in said vapor line and connected in series with said hot water heater and the vapor generator of said absorption chiller, the heat of vaporization expended in the desiccant regenerator being recovered and used to partially preheat said driving fluid of said absorption chiller; a chilled water storage unit coupled to the evaporator of said absorption chiller; an air cooler provided with a cooling coil and an output air line to said building, said cooling coil coupled to said chilled water storage unit; and said air cooler coupled to said air output line from said dehumidifier, said air cooler removing the sensible load from the dehumidified air flowing therethrough before exiting to said building.

2. The system set forth in claim 1, wherein said desiccant is an aqueous solution of LiCl, and said absorption chiller is a LiBr absorption chiller.

3. The system set forth in claim 2, wherein an auxiliary electrical heater is provided and connected in series with said solar collector for further heating the water in said regenerator heating coil.

4. The system set forth in claim 2, wherein said hot water heater is not utilized and its function is provided by said solar collector such that said solar collector serves the dual function of heating the driving fluid of said absorption chiller as well as supplying the heating coil of said regenerator, said solar collector being connected through said ejector which ejector is connected to the output of said low pressure compressor.

5. The system set forth in claim 2, wherein a steam boiler is substituted for said hot water heater, the steam of said steam boiler being coupled through said ejector to said vapor generator of said absorption chiller and then back to said steam boiler, said ejector then acting as a thermocompressor.

6. The system set forth in claim 2, wherein a low temperature waste heat source is substituted for said hot water heater with the heat therefrom being coupled through said ejector to said vapor generator of said absorption chiller, and further including a compressor coupled between the vapor generator and condenser of said absorption chiller.

* * * * *